US011352845B2

(12) United States Patent
O'Brien et al.

(10) Patent No.: US 11,352,845 B2
(45) Date of Patent: Jun. 7, 2022

(54) ACTUATION TRIGGER

(71) Applicants: Robert O'Brien, Katy, TX (US); Aaron Hammer, Houston, TX (US); Roy Woudwijk, Spring, TX (US)

(72) Inventors: Robert O'Brien, Katy, TX (US); Aaron Hammer, Houston, TX (US); Roy Woudwijk, Spring, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 418 days.

(21) Appl. No.: 16/360,255

(22) Filed: Mar. 21, 2019

(65) Prior Publication Data

US 2019/0292862 A1 Sep. 26, 2019

Related U.S. Application Data

(60) Provisional application No. 62/646,230, filed on Mar. 21, 2018.

(51) Int. Cl.

| | |
|---|---|
| ***E21B 23/00*** | (2006.01) |
| ***E21B 34/06*** | (2006.01) |
| ***E21B 34/14*** | (2006.01) |
| ***E21B 23/04*** | (2006.01) |

(52) U.S. Cl.

CPC ..... *E21B 23/00* (2013.01); *E21B 23/04* (2013.01); *E21B 34/063* (2013.01); *E21B 34/14* (2013.01)

(58) Field of Classification Search

CPC ..... E21B 23/00; E21B 23/04; E21B 23/0411; E21B 23/04115; E21B 23/0412–0419; E21B 23/042–0423; E21B 34/14; E21B 34/063; E21B 34/142

See application file for complete search history.

(56) References Cited

U.S. PATENT DOCUMENTS

| | | | | |
|---|---|---|---|---|
| 3,831,680 | A | 8/1974 | Edwards et al. | |
| 5,819,854 | A | 10/1998 | Doane et al. | |
| 5,927,328 | A * | 7/1999 | Nelson | F16K 21/06 137/624.12 |
| 6,340,062 | B1 | 1/2002 | Skinner | |
| 7,303,020 | B2 | 12/2007 | Bishop et al. | |
| 7,775,283 | B2 | 8/2010 | Coronado et al. | |
| 7,870,908 | B2 | 1/2011 | Mandrou | |
| 8,261,817 | B2 | 9/2012 | Hayterr et al. | |
| 8,602,105 | B2 | 12/2013 | Sinclair | |

(Continued)

OTHER PUBLICATIONS

Notification of Transmittal of the International Search Report and the Written Opinion of the International Searching Authority, or the Declaration; PCT/US2018/051993; dated Jan. 29, 2019; 9 pages.

(Continued)

*Primary Examiner* — George S Gray

(74) *Attorney, Agent, or Firm* — Cantor Colburn LLP

(57) ABSTRACT

An actuation trigger including a housing; a piston in operable communication with the housing; a pressure source inlet to the trigger the piston being responsive to source pressure cycles; a first one-direction axial incrementing feature movable with piston movement; a rod movable with the piston and positionally restricted by the one-direction axial incrementing feature, the rod initially being part of a dynamic seal preventing actuation pressure access to a tool actuatable by the actuation pressure.

21 Claims, 9 Drawing Sheets

(56) References Cited

U.S. PATENT DOCUMENTS

| | | | | |
|---|---|---|---|---|
| 9,309,745 | B2 | 4/2016 | Patel | |
| 9,359,865 | B2 | 6/2016 | Mailand et al. | |
| 9,752,412 | B2 | 9/2017 | Shkurti et al. | |
| 2007/0193377 | A1 | 8/2007 | Irani et al. | |
| 2011/0017471 | A1 | 1/2011 | Frazier | |
| 2011/0036585 | A1* | 2/2011 | Sinclair | E21B 34/063 166/317 |
| 2014/0008085 | A1 | 1/2014 | Tinnen | |
| 2014/0076578 | A1 | 3/2014 | Hofman et al. | |
| 2014/0116721 | A1 | 5/2014 | Hofman et al. | |
| 2015/0041148 | A1 | 2/2015 | Greenan | |
| 2015/0233208 | A1 | 8/2015 | Muscroft et al. | |
| 2017/0022783 | A1 | 1/2017 | Yong et al. | |
| 2017/0370168 | A1 | 12/2017 | Farrar et al. | |
| 2018/0073328 | A1* | 3/2018 | Hammer | E21B 34/102 |
| 2018/0187501 | A1 | 7/2018 | Van Petegem et al. | |
| 2019/0128099 | A1 | 5/2019 | Woudwijk | |
| 2021/0095543 | A1* | 4/2021 | Kent | E21B 34/10 |

OTHER PUBLICATIONS

Notification of Transmittal of the International Search Report and the Written Opinion of the International Searching Authority, or the Declaration; PCT/US2019/023315; dated Jul. 2, 2019; 9 pages.

* cited by examiner

ACTUATION TRIGGER

CROSS REFERENCE TO RELATED APPLICATIONS

This application claims the benefit of an earlier filing date from U.S. Provisional Application Ser. No. 62/646,230 filed Mar. 21, 2018, the entire disclosure of which is incorporated herein by reference.

BACKGROUND

In resource recovery industries it is often necessary to actuate various tools using fluid pressure. Fluid pressure actuation is quite reliable when only one thing at one pressure needs to be actuated but can become less reliable when multiple actuations must occur through multiple pressure events. In this case, configuration are created that delay actuation of some tools in order to allow actuation of others. While resource recovery operations occur regularly indicating the success of many different configurations for actuating tools in some preordained order, there are still circumstances where actuations are difficult and therefore potentially costly or dilatory. The art therefor will well receive alternatives that expand operational options, reduce cost and/or increase efficiency.

SUMMARY

An actuation trigger including a housing; a piston in operable communication with the housing; a pressure source inlet to the trigger the piston being responsive to source pressure cycles; a first one-direction axial incrementing feature movable with piston movement; a rod movable with the piston and positionally restricted by the one-direction axial incrementing feature, the rod initially being part of a dynamic seal preventing actuation pressure access to a tool actuatable by the actuation pressure.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
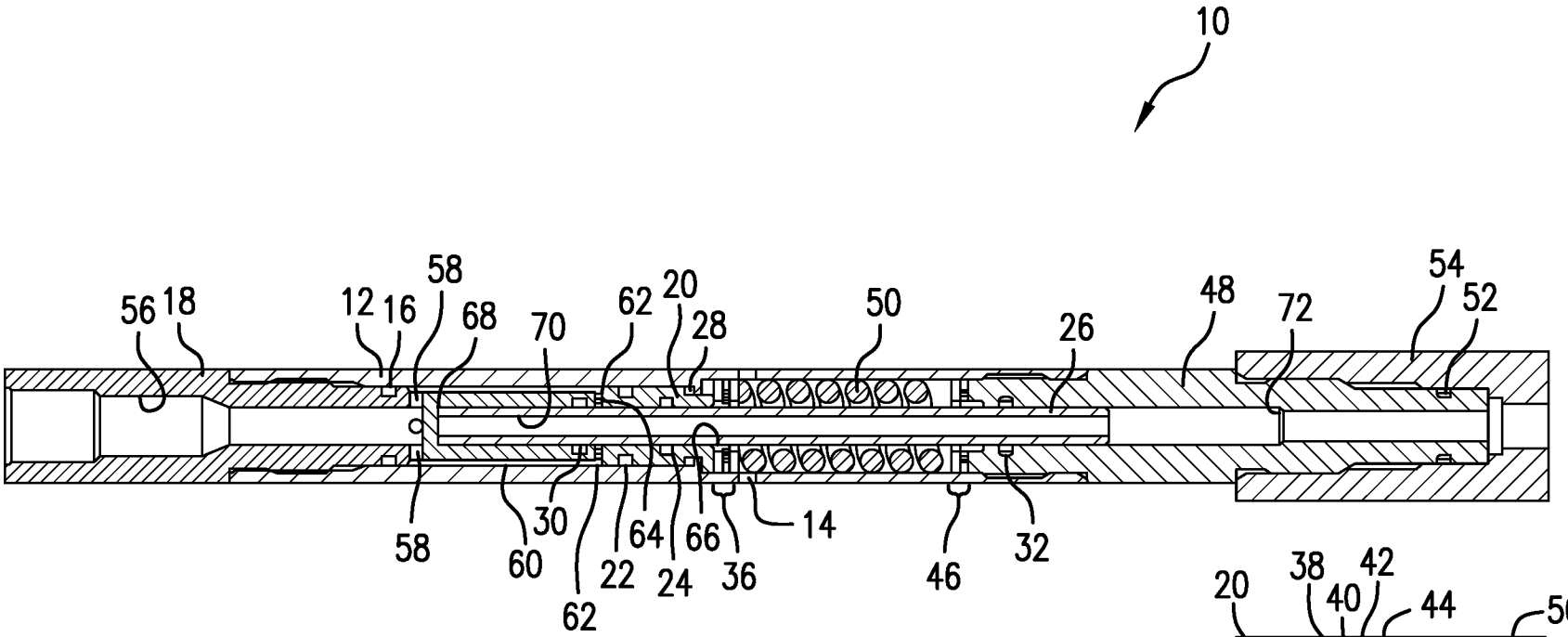
FIG. 1 is a cross sectional view of an embodiment of a trigger as disclosed herein in a first condition.
Figure 2:
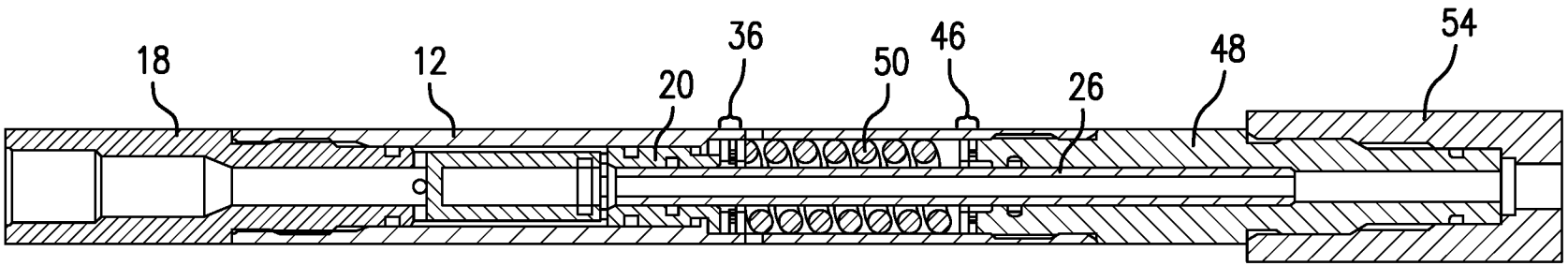
FIG. 2 is a cross sectional view of the embodiment of FIG. 1 in a second condition.

Referring to FIGS. 1 and 2, a trigger 10 is illustrated in a first position wherein the trigger 10 is ready for use (FIG. 1), and in a second position (FIG. 2) wherein the trigger has been triggered and the ultimate tool (not shown) has been provided an impetus for actuation. It is to be appreciated that the triggers as disclosed herein may be used for many different types of tools including but not limited to wellbore tools that require actuation including those employing an atmospheric chamber, those employing hydraulic pressure to actuate, those employing electric actuation means, etc. Examples of such tools include packers, barrier valves, injection tools, plugs, bridge plugs, running tools, etc. The trigger may also be used as a pressure protection device for a rupture disk (or a shear device that shears due to application of pressure, etc.) so that pressure is segregated from the pressure disk until a certain number of pressure events has occurred. The term "source" or "source pressure" as used herein may be used for both fluid pressure that acts on the various embodiments of the trigger and also is the pressure that actuates the ultimate tool or in some embodiments the "source" or "source pressure" may act only on the trigger while another "actuation pressure" acts on the ultimate tool, that "actuation pressure" coming from an alternate place. One example would be source pressure from the tubing ID and actuation pressure from the annulus. Tubing ID, annulus and dedicated control lines are examples of different places where pressure can come from and various embodiments hereof could use one or a combination of these for the pressures needed. Accordingly, it should be understood in the various embodiments that sometimes the pressure (source pressure) that acts on the trigger is also the pressure (actuation pressure) that acts on the ultimate tool and sometimes the pressure (source pressure) that acts on the trigger is different than the pressure (actuation pressure) that acts on the tool.

The trigger 10 of FIG. 1 includes a housing 12 having differential pressure ports 14. Statically sealingly attached to the housing 12 through static seal 16 is a pressure inlet sub 18 connectable to a modulatable pressure source such as, in a wellbore for example, tubing pressure, annulus pressure or a dedicated pressure source. If tubing pressure is to be used, then the differential pressure ports 14 will be fluidly connected to annulus pressure. If annulus pressure is the source for inlet sub 18, then the differential ports will 14 will be fluidly connected to tubing pressure. Where a dedicated control line is the pressure source for inlet sub 18, the differential ports 14 may be fluidly connected to either the tubing or the annulus (not both). In any of these cases, the pressure applied through the sub 18 acts upon a piston 20 that is housed within the housing 12 and dynamically sealed thereto with seal 22. The piston 20 is also dynamically sealed at seal 24 to a flow rod 26. Upon application of pressure through sub 18, the piston will cycle a short distance 28. Reduction of the applied pressure will allow the piston 20 to return to the starting point illustrated in FIG. 1. It will be understood that the distance moved by the piston 20 may be quite short. In an embodiment, the distance only measures about 1/16 inch (this is not intended to be a limitation but only an example as longer and shorter distances may be employed). The function of this movement will be addressed hereinbelow.

The flow rod 26 is also dynamically sealed to the inlet sub 18 via seal 30 and to a connector 48 via seal 32. In this embodiment the trigger event for the ultimate tool will occur when the flow rod 26 disengages the seal 30 due to movement of the flow rod 26 to a position where it cannot physically engage the seal 30. Also in operable communication with the flow rod 26 are one-way incrementing features 36 and 46.

Figure 1A:
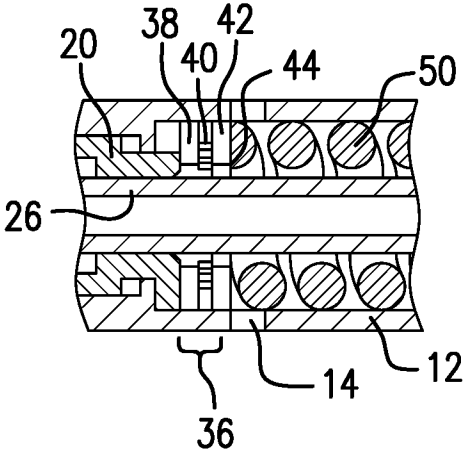
FIG. 1A is an enlarged view of a portion of FIG. 1.

Referring to FIGS. 1 and 1A simultaneously, incrementing feature 36 in one embodiment comprises a first washer 38, a push nut 40, and a second washer 42 positioned adjacent one another in the order recited such that the washers 38 and 42 protect the push nut 40 from damage and allow it to function as intended, i.e. slide on the flow rod in one direction and jam in the opposite direction. Referring to FIG. 1A, an enlarged view of one embodiment of the feature 36 facilitates greater understanding. The push nut 40 includes collet fingers 44 that allow movement of the flow rod 26 in one direction but inhibit movement of the flow rod 26 in the opposite direction. At least the washer 42 has an inside diameter opening sufficient to allow flexion of the collet fingers 44 and will protect the fingers 44 from impingement on other structures that might damage them. Incrementing feature 46 as illustrated is similar but does not employ the equivalent washer to washer 42 since the push nut 40 in incrementing feature 46 abuts a connector 48 that does not pose a likelihood of damage to the push nut 40 in feature 46. It is to be understood that other one-way incrementing configurations are also contemplated.

Further disposed within housing 12 is a biasing member 50, such as for example a compression spring of any type, configured to bear against the incrementing feature 36 on one end of the spring and against incrementing feature 46 on the opposite end of the spring 50.

It should further be noted that connector 48 is to be statically sealingly connected through a seal 52 to a tool at trigger interface 54.

Turning now to operation of the trigger 10, the sub 18 is connected to a fluid pressure source, which may be as noted, tubing pressure, annulus pressure or a dedicated control line, for example. Fluid then flows within an inside path 56 of sub 18 to ports 58 into an annulus 60 between the sub 18 and housing 12. Annulus 60 is connected to ports 62 which allow fluid pressure to be communicated to a face 64 of piston 20. It will be noted that an opposite face 66 of piston 20 is exposed to differential pressure ports 14 that, as noted above, will be exposed to a volume other than the pressure source for the sub 18. This allows for a pressure differential to be built across piston 20 thereby moving the piston 20 to the right in the drawing. Movement of the piston 20 necessarily causes the incrementing feature 36 to move as well and compresses the spring 50. The feature 36 is configured and positioned to grip the flow rod 26 in the direction of movement of the piston 20 when under pressure and to move relative to the flow rod in the opposite direction when the piston is allowed to return to its home position based upon the spring 50 becoming the dominant force on the piston 20 after fluid pressure through sub 18 is relieved. In the Figure, the collet fingers 44 are extended toward the right of the figure such that piston movement toward the right of the figure will also cause the flow rod 26 to move toward the right of the figure. When the piston returns to its home position due to the bias of spring 50 the incrementing feature 36 will move relative to the flow rod 26 to take up a new position relative to that rod 26. The flow rod 26 will hold its new moved position due to the action of incrementing feature 46, which allows relative movement of rod 26 in the rightward direction of the figure (the direction of piston movement under pressure) and does not allow relative movement of rod 26 leftwardly of the figure (the direction of movement of the piston 20 under spring 50 bias). Hence any movement the flow rod 26 makes in the rightward direction, pursuant to the piston and incrementing feature 36 pushing the rod 26 in that direction is maintained by incrementing feature 46. As was noted above, the stroke length of the piston 26 may limited such that any given pressure event applied through sub 18 will only move the piston a short distance and hence accordingly only move the flow rod a short distance. This is used to allow the trigger 10 to experience multiple pressure rises before ultimately triggering the actuation of the tool to which the trigger 10 is attached. The number of increments possible depends upon the length of the flow rod 26 and the distance the piston 20 moves for each pressure event, in one embodiment. More specifically, the flow rod 26 has an end 68 and a passage 70 therein. The flow rod 26 is sealed to the sub 18 by seal 30 as noted above which segregates the pressure source from the passage 70. As the flow rod 26 moves further to the right in the figure, it will be appreciated that at some preselected number of increments, the end 68 will move rightwardly of the seal 30 thereby communicating the pressure source through sub 18 to the passage 70. At this point the pressure is delivered to the tool and acts as the trigger for that tool to actuate. The condition of the trigger 10 at this point is illustrated in FIG. 2.

It is noted that to avoid direct communication between source pressure and the differential ports 14, which may in some iterations be tubing pressure to annulus pressure, the connector 48 includes a shoulder 72 that prevents flow rod 26 from moving far enough to unseal from seal 24.

Figure 3:
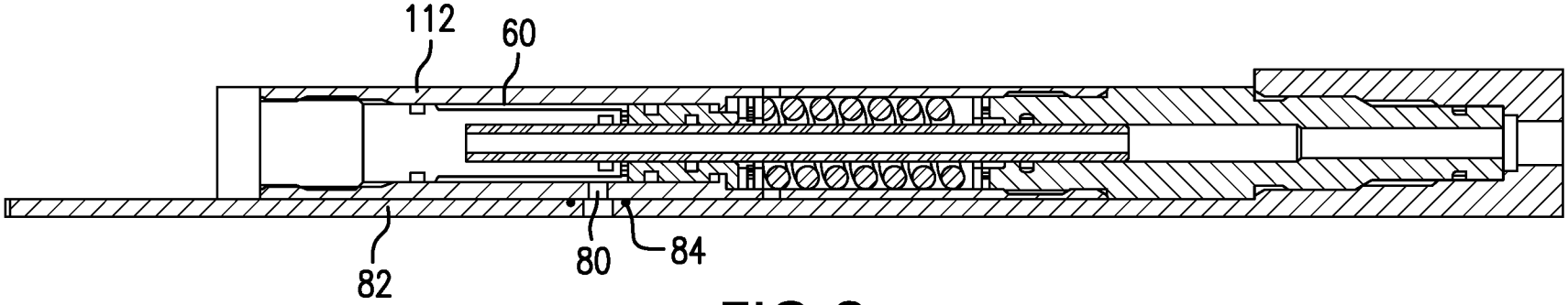
FIG. 3 is a cross sectional view of a second embodiment of a trigger as disclosed herein.

Referring to FIG. 3, an alternate embodiment of the trigger here denoted 110 is illustrated that changes the pressure source connection location from the sub 18 of the embodiment of FIG. 1 to another location. Specifically, an inlet 80 is provided in housing 112 (a homolog of housing 12) and the inlet sub 18 is replaced by a plug sub 118. It will be appreciated that the fluid pressure source is now tubing pressure accessed directly through a tubing wall 82 and sealed with seal 84. The fluid pathway in this embodiment bypasses what was in the FIG. 1 embodiment the sub 18 but picks up that pathway at the annulus 60. The balance of the trigger 110 is identical to the embodiment of FIG. 1.

Figure 4:
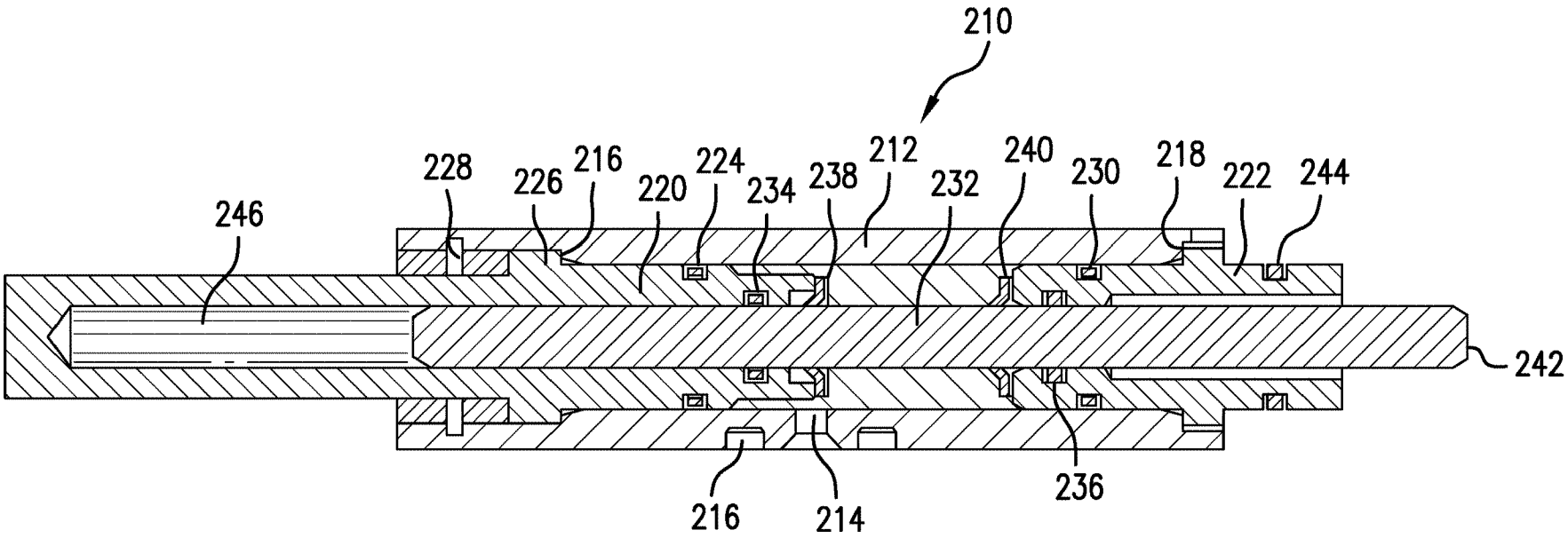
FIG. 4 is a cross sectional view of a third embodiment of a trigger as disclosed herein.

Referring to FIG. 4, another embodiment of the trigger, here denoted 210, is illustrated. This embodiment includes a housing 212 having a pressure source access point opening 214 with a seal 216. Similarly to the foregoing embodiment, the pressure source for this embodiment is intended to be tubing pressure accessed directly through the wall of a tubular upon which the trigger 210 is positioned. The housing 212 is configured with opposing shoulders 216 and 218. Partially within the housing are a piston 220 and a connector 222. The piston 220 is dynamically sealed to the housing with seal 224 and includes an upset 226 configured to abut shoulder 216. The connector 222 is fixedly attached to the housing 212 to maintain its position relative thereto at all times. During use, the upset 226 also interacts with retainer 228. The connector is also sealed to the housing 212.

In this case seal 230 does the job. Finally a rod 232 is sealed at seal 234 to piston 220 and at seal 236 to connector 222. The rod 232 is solid as opposed to its hollow analogs in the above embodiments. Provided adjacent the piston 220 is an incrementing feature 238 (again a push nut configuration is one possible embodiment) and adjacent the connector 222 another incrementing feature 240 (again a push nut configuration is one possible embodiment). These work similarly to those discussed above in that they allow one-way movement and when working together cause the rod 232 to incrementally move in a single direction until ultimately the trigger 210 allows actuation of the attached tool.

Referring to the connector 222, it is noted that a seal 244 is provided thereon to sealingly interact with a tool interface (not shown). Specifically, the tool interface will provide a bore sized to accept the connector 222 and seal thereagainst through the seal 244.

Further noted is that in an embodiment, the piston 220 may contain an atmospheric chamber 246 into which the rod 232 must move during use. The atmospheric chamber is desirable where the tool connector 222 will also house an atmospheric chamber to thereby approximate a balance condition across the rod 232. This is not limited to atmospheric pressure however in that regardless of what pressure is a condition of use of the connector 222, the opposing end of the trigger at chamber 246 will benefit from being of a simiar pressure magnitude so that the balance condition will be achieved. It will be understood that increasing pressure for each of the pressure events in the trigger 210 may be necessary to cycle the piston due to the compression of the fluid within the atmospheric chamber as the rod moves into the chamber.

Still referring to FIG. 4, in operation, the pressure events from tubing (not shown) are conveyed through access point opening 214 into a volume defined within housing 212, piston 220 and connector 222. The pressure applied therein causes piston 220 to move leftwardly of the Figure until upset 226 contacts retainer 228. As the incrementing feature 238 is affixed to the piston 220, this motion also causes the rod 232 to move leftwardly of the figure. Upon a reduction in pressure applied to the trigger 210, the piston 220 is moved back to the initial position due to hydrostatic forces acting thereon from the environment outside of the trigger 210 such as a wellbore annulus. The rod 232 cannot move rightwardly because of incrementing feature 240 and feature 238 may move relative to the rod 232 in the rightward direction of the Figure. It will be understood that each pressure event will cycle the piston between shoulder 216 and retainer 228 moving the rod 232 incrementally to the left of the Figure. This will continue for each pressure event until the rod 232 unseals with seal 236 by drawing an end 242 of rod 232 out of the seal 236. This allows tubing pressure to access the connected tool for actuation.

It is to be understood that in the specific embodiment shown in FIG. 4, tubing pressure is balanced against annulus pressure. In situations where the trigger 210 is to be used in low depth positions, there may be insufficient hydrostatic pressure in the annulus to support the proper function of the trigger 210. In these events, it may be helpful to bias the piston to the initial position by adding a compression spring or other similar biasing means to the space between the retainer 228 and the upset 226.

It is also to be understood that while the embodiments hereof have been described as actuation triggers, they all may also be characterized as valves in some utilities. Because the fluid that acts as the pressure source ultimately is passed through the trigger upon achievement of the selected number of pressure events, that fluid becomes available downstream of the triggers 10, 110, 210. Fluid that is supplied to a device that then either prevents or permits passage of that fluid, then that device is definitionally a valve. The triggers disclosed can be employed as valves if a need presents itself.

Figure 5:
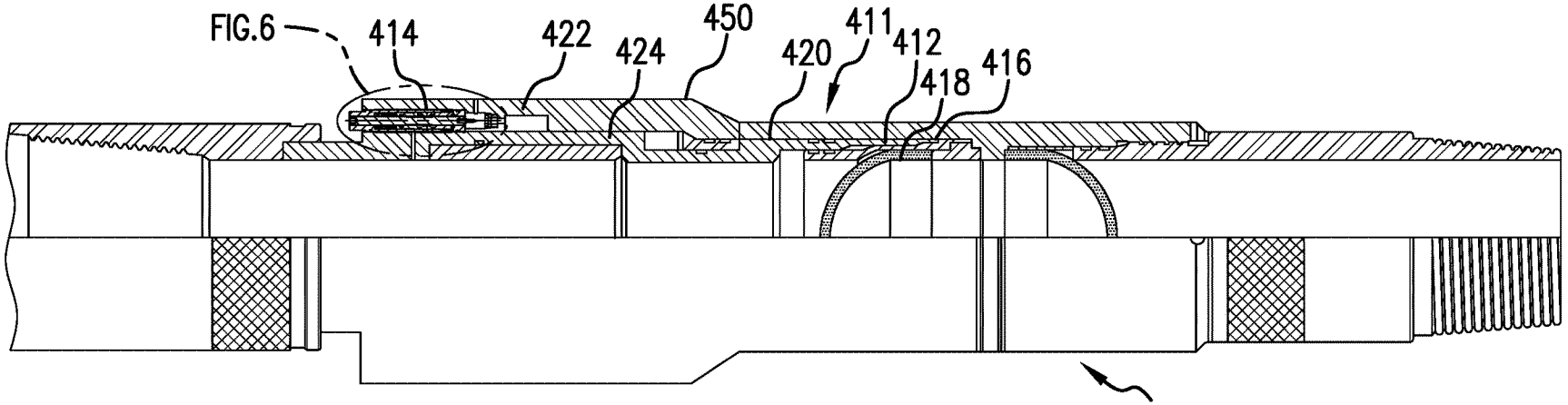
FIG. 5 illustrates an actuation system having an actuator and a trigger for the actuator in an untriggered and unactuated condition.

Referring to FIG. 5, a multiple event trigger and actuation system 410 is illustrated having an actuator 412 and a trigger 414. The actuator 412 includes sections similar to a commercially available product from Magnum Oil known commercially as Magnum Disk and US patent publication number 2017/0022783. These sections are the actuation component 416, a frangible dome 418 and a pressure shiftable sleeve 420. The balance of the actuator 412 is modified in order to allow the actuator 412 to be responsive to the trigger 414, which trigger is commercially known as Caledyne CBV barrier valve actuator U.S. Pat. No. 8,602,105.

The system 410 includes a housing 411 that houses the trigger 414 and the actuator 412 in operative communication with one another. The trigger 414 allows a selected number of tubing pressure up events before allowing annulus pressure to access a trigger chamber 422. Chamber 422 is fluidically connected to trigger transfer sleeve 424, which is in operable communication with shiftable sleeve 420. In FIG. 5, it can be seen that the trigger transfer sleeve 424 is directly abutting the shiftable sleeve 420 though other configurations are also contemplated.

Figure 6:
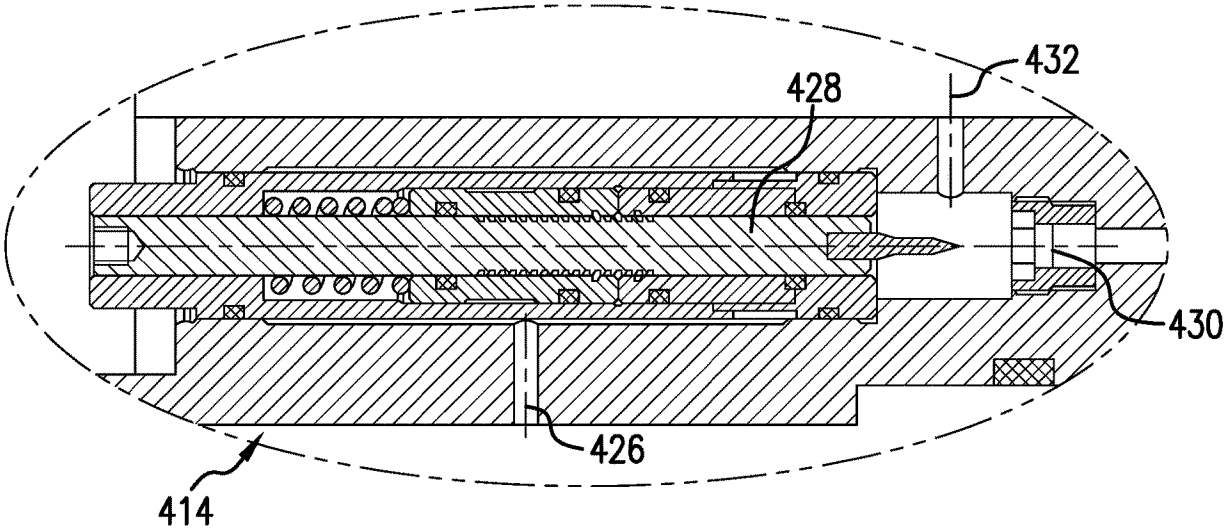
FIG. 6 is an enlarged view of the circumscribed 6-6 area of FIG. 5.
Figure 7:
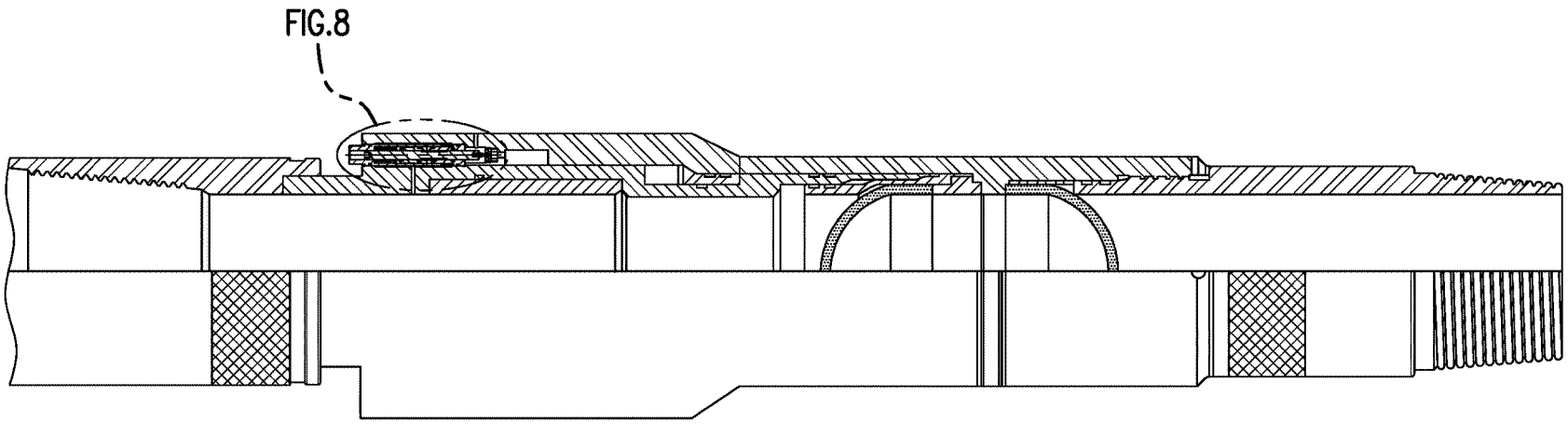
FIG. 7 illustrates the actuation system having an actuator and a trigger for the actuator in a triggered and actuated condition.
Figure 8:
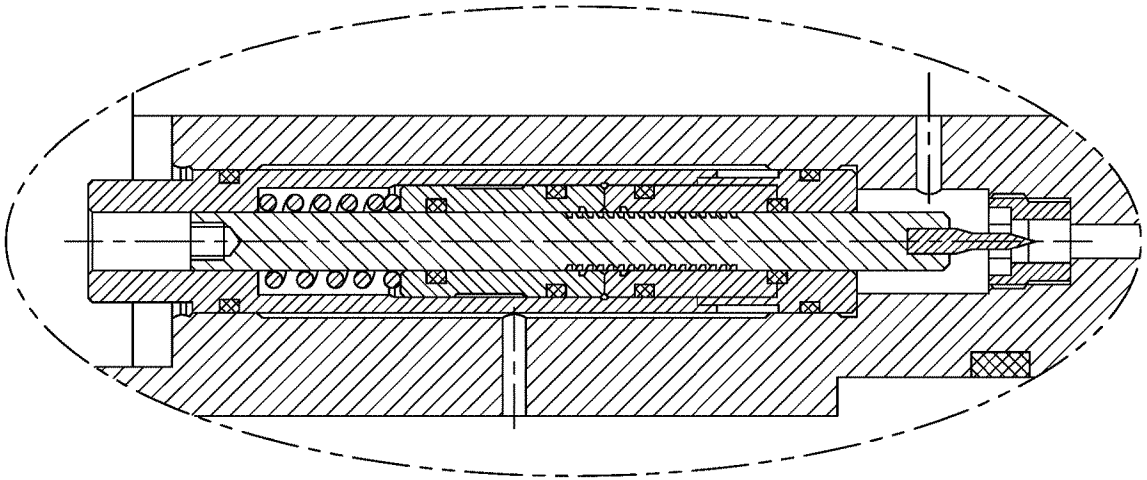
FIG. 8 is an enlarged view of the circumscribed 6-6 area of FIG. 5 illustrating the triggered position.

The trigger 414, referring to FIG. 6, includes an access port 426 to tubing pressure which allows for tubing pressure up events to cause cycling of the trigger 414. The trigger 414 may be set to cycle a number of times before activation. The trigger 414 includes an incrementally movable stem 428 configured to be retained in a new incremented position subsequent to each pressure cycle. The configuration may employ a holding configuration such as a ratcheting pawl 429 or may employ a sliding jamb member (not shown) but is commercially available as part of the Caledyne CBV barrier valve actuator. During each cycle, a stem 428 will move incrementally closer to a rupture disk 430. When enough cycles, i.e. the selected number of cycles for which the trigger 414 was set, occur the stem 428 will have come into contact with and pierced the rupture disk 430 (note that more than one disk may be substituted to increase a number of stages of rupture disk before communication occurs). It can be seen that there is a port 432 from the trigger 414 that accesses annulus pressure such that after rupture of the disk 430, annulus pressure is ported to the chamber 422 and the end of trigger transfer sleeve 424. Upon the sleeve 424 being exposed to annulus pressure, it will begin moving in the direction of the actuation component 416. The shiftable sleeve 420 will be shifted due to the movement of the trigger transfer sleeve 424 and will cause the actuation component 416 to put a stress on the dome 418. From this point, the function of the actuator 412 is the same as the commercially available Magnum product mentioned above. Specifically, the actuation component is urged against the dome 418 to create a significant stress increase therein resulting in the shattering of the dome 418 thereby.

In order to configure the Magnum actuator to function with the Caledyne trigger, the magnum actuator is constructed with a housing extension 450 that has dimensions and position to support the trigger 414 axially relative to housing 411. This is advantageous due to a length of the trigger 414. Housing extension 450 is configured to have fluidic access to the inside diameter of the tool to access tubing pressure for the incremental operation of the trigger 414 and is configured to port annulus fluid to the chamber 422 for activation of the system 410 subject to the stem 428 puncturing the disk 430.

As configured herein, the actuator 412 is triggerable only after a preselected number of pressure events each one of which is sufficient to cause an increment of movement of the stem 428 of the trigger. Upon reaching the preselected number of pressure events the actuator is triggered. This allows for reduced cost in number of tools employed, and reduced rig time. Rig time is reduced since multiple operations can be performed in a single run without the requirement of individual pressure event configurations being employed with different pressure thresholds but rather pressure events can be stacked and then the actuator triggered only after the selected number of pressure events has occurred.

Figure 9:
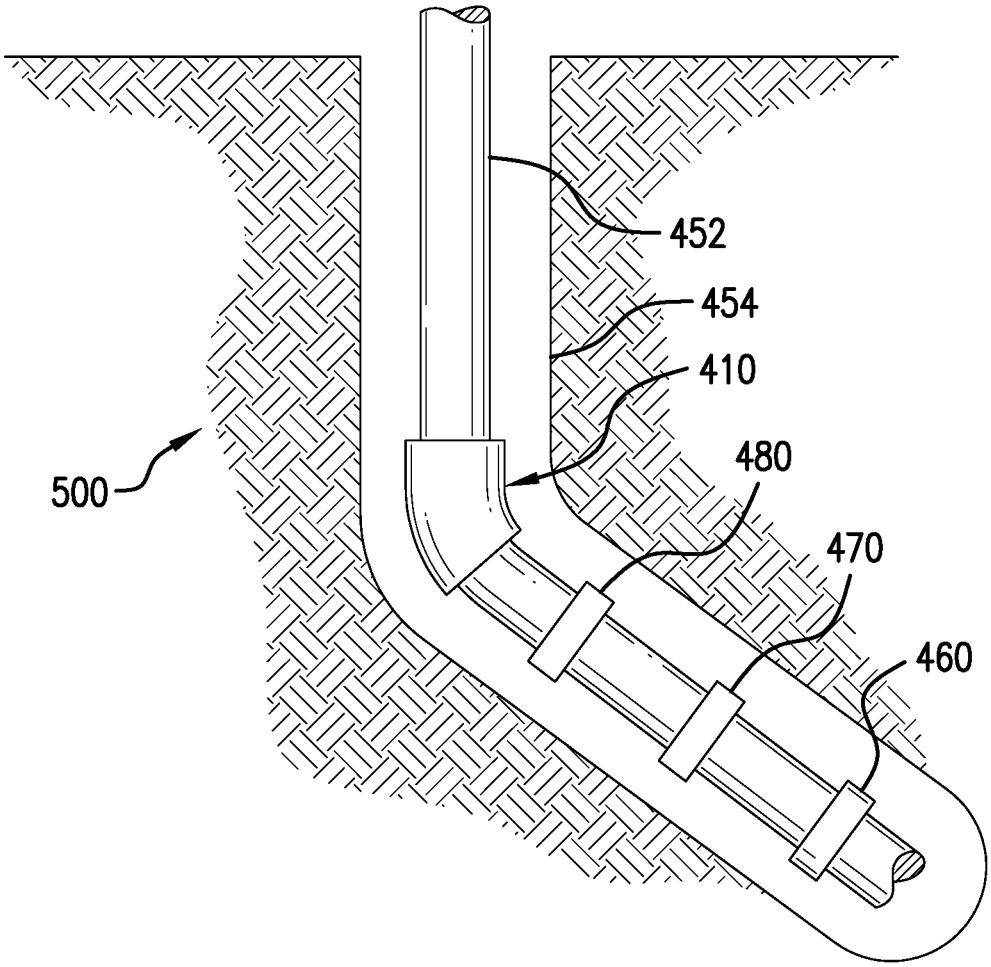
FIG. 9 is a schematic representation of a borehole system configured with the trigger and actuator disclosed herein.

Referring to FIG. 9, a schematic view of a borehole system 500 illustrates a tubing string 452 disposed in a borehole 454, the string 452 having a number of pressure responsive tools 460, 470, and 480 therein and also a multiple event trigger and actuation system 410. Pressure events may be used to cause each of the tools 460, 470, 480 to respond individually prior to the system 410 activating to trigger the actuator 412. The overall borehole system then is significantly more efficient than prior art systems in that the multiple pressure event capability will reduce rig time and streamline installations.

Any of the forgoing trigger embodiments may be substituted for trigger 414 as desired.

Figure 10:
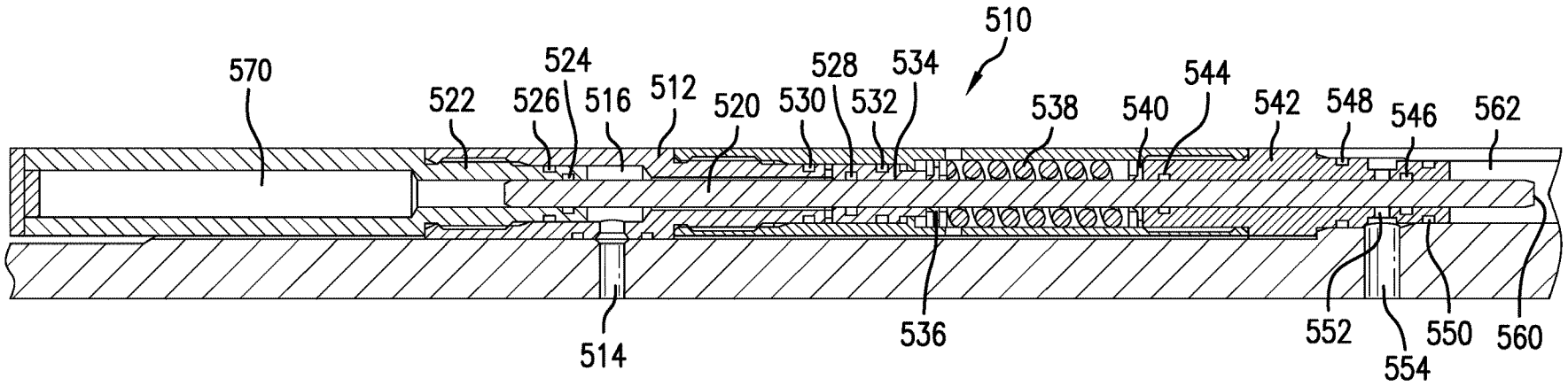
FIG. 10 is a cross sectional view of a fourth embodiment of a trigger as disclosed herein.

In yet another embodiment, a trigger 510 is illustrated in FIG. 10. The trigger 510 comprises a housing 512. Housing 512 includes a source pressure inlet 514 allowing a pressure source such as tubing pressure, annulus pressure or a dedicated control line, for example, to act on the trigger 510 through a volume 516 bounded by trigger rod 520, first sub 522, seals 524, 526, 528, 530 and 532, and a piston 534. The piston 534 is movable within housing 512 in response to applied pressure to the volume 516. Adjacent the piston 534 is an incrementing feature 536 adjoining a biasing member 538 such as a spring. As illustrated the biasing member 538 is a compression coil spring. Another incrementing feature 540 is illustrated disposed near an opposite end of the biasing member 538. The two incrementing features work together to allow incremental movement of the trigger rod in a single axial direction. To the right in FIG. 10 is a connector 542. It is to be appreciated that "first" and "second" have no particular meaning and signify no order. Rather the terms are used solely to distinguish two components. Connector includes seal 544 and 546 to interface with the trigger rod 520 and seals 548 and 550 to interface with the housing 512. The connector 542 includes a conduit 552 in fluid communication with a port 554 connected to an actuation pressure source, which in the embodiment of FIG. 10 happens to be the same as the source pressure for the trigger 510. In the embodiment of FIG. 10, the actuation pressure is tubing ID pressure through port 554; in the FIG. 11 embodiment the actuation pressure is annulus pressure through port 554A. The distinction is easy to appreciate by viewing the two Figures.

Figure 11:
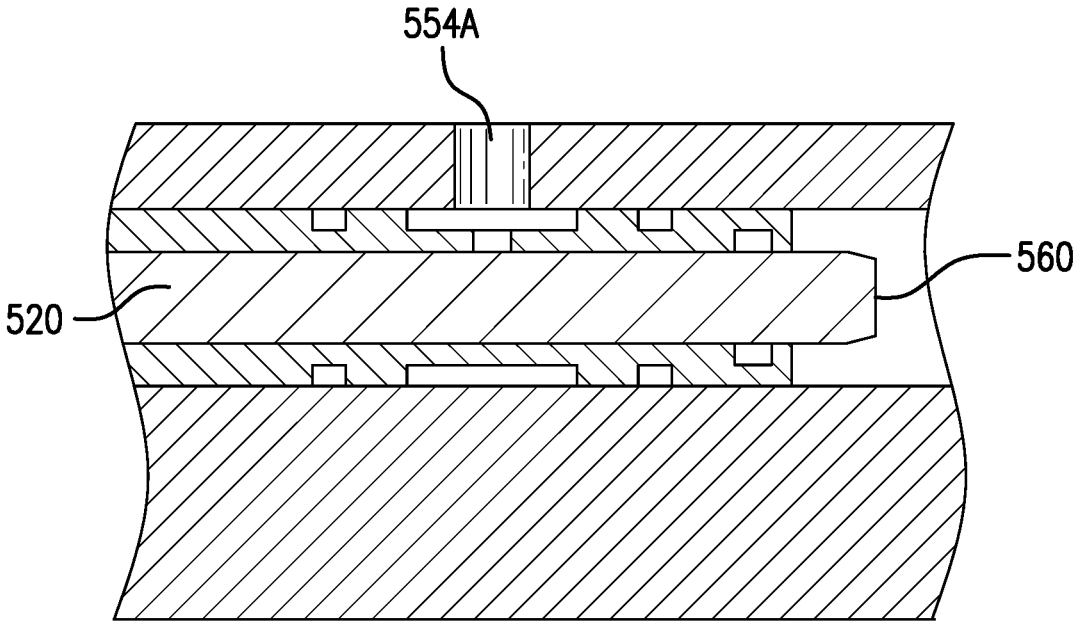
FIG. 11 is a cross sectional view of a portion of the fourth embodiment of a trigger as disclosed herein but with the tool actuation pressure illustrated to be annulus pressure rather than tubing pressure.

The embodiments of FIGS. 10 and 11 both work in the same way but ultimately apply an actuation pressure from different places, i.e., the tubing ID or the annulus. Similarly to the foregoing embodiments, source pressure is applied from such as the tubing ID as shown in FIG. 10 but it will be appreciated that a dedicated line or the annulus could be used by switching the location of source pressure inlet 514 to the annulus side instead of the tubing ID side. In any event, pressure episodes cause the piston 534 to move to the right of the Figure. The trigger rod does not move during the compression of the spring but rather is held in place by incrementing feature 540. When pressure is relieved in inlet 514, the biasing member 538 will push piston 534 back toward the left of the Figure and due to incrementing feature 536, will take trigger rod 520 with it. Accordingly, the rod 520 will move to the left of the figure by a distance equal to the distance the biasing member 538 is compressed during each pressure cycle. The rod 520 as it moves leftwardly of the figure resides more and more in a chamber 570, that chamber having a pressure close to equal with a pressure of a volume 562. If 562 is an atmospheric chamber then chamber 570 may also be an atmospheric chamber, for example. It is also possible in an embodiment to provide a fluid communication path between volume 562 and chamber 570 to ensure balanced pressure across rod 520. The communication path could be a control line, a fluid pathway through the housing, etc. providing that the chamber 570 and volume 562 are pressure linked. Eventually, depending upon the selected number of pressure cycles needed for actuation of a dependent tool, the rod 520 will move far enough to the left of the figure to have a nose 560 move leftwardly of seal 546. When this occurs, the conduit 552 becomes fluidly connected to volume 562, which volume is operatively connected to a tool that will be actuated when pressure is applied to the volume 562. With conduit 552 fluidly connected to volume 562, tubing ID pressure through port 554 may be applied to the the tool to be actuated (not shown). In the embodiment of FIG. 10, the pressure comes from the Tubing ID whereas in the embodiment of FIG. 11 the pressure comes from the annulus through port 554A as noted above. An advantage of the embodiments of FIGS. 10 and 11 are that they avoid surge to the tool that is ultimately to be actuated because the rod 520 does not move when pressure is high but rather only when pressure has been bled off to allow the biasing member 538 to reassert its resting length. This means that the rod end 560 can only move left of the seal 546 when applied pressure is low, for example, if the system works by applying 5000 psi to compress the member 538 and then pressure is bled down to 1000 psi to allow the incrementing feature 536 to move the rod 520, then the 1000 psi is the pressure at which the rod end 560 will clear the seal 546 and only allow 1000 psi and hydrostatic pressure to flow to the ultimate to be actuated tool.

It is also important to note that in each case for all of the embodiments disclosed herein, where there are seals and seal surfaces engaging those seals is it possible to reverse where the seal is and where the surface is. For example, seal 546 is disposed in a seal recess in connector 542 and the seal 546 engages a surface of rod 520 in a sealing manner. It is contemplated however that the seal 546 could be disposed in a recess in the rod 520 instead and engage a surface of the connector 542. This is simply a reversal of the operating components and will be easily appreciated by one of ordinary skill in the art.

It is to be understood for all embodiments that all or any combination of nonmoving components could be constructed as a single member.

Set forth below are some embodiments of the foregoing disclosure:

Embodiment 1: An actuation trigger including a housing; a piston in operable communication with the housing; a pressure source inlet to the trigger the piston being responsive to source pressure cycles; a first one-direction axial incrementing feature movable with piston movement; a rod movable with the piston and positionally restricted by the one-direction axial incrementing feature, the rod initially being part of a dynamic seal preventing actuation pressure access to a tool actuatable by the actuation pressure.

Embodiment 2: The trigger as in any prior embodiment, wherein the actuation pressure is the source pressure.

Embodiment 3: The trigger as in any prior embodiment, wherein the actuation pressure is distinct from the source pressure.

Embodiment 4: The trigger as in any prior embodiment, wherein the rod is pressure balanced.

Embodiment 5: The trigger as in any prior embodiment, including a biasing member in operable contact with the piston.

Embodiment 6: The trigger as in any prior embodiment, further including a second incrementing feature.

Embodiment 7: The trigger as in any prior embodiment, wherein the pressure source inlet is through a pressure inlet sub.

Embodiment 8: The trigger as in any prior embodiment, wherein the dynamic seal is in the pressure inlet sub.

Embodiment 9: The trigger as in any prior embodiment, wherein the dynamic seal is in a connector attached to the housing.

Embodiment 10: The trigger as in any prior embodiment, wherein the rod is hollow.

Embodiment 11: The trigger as in any prior embodiment, wherein the rod is solid.

Embodiment 12: The trigger as in any prior embodiment, wherein the housing is configured to directly access tubing pressure of a tubular member adjacent the trigger.

Embodiment 13: The trigger as in any prior embodiment, wherein the pressure source inlet is connected to tubing pressure in a tubular within a wellbore.

Embodiment 14: The trigger as in any prior embodiment, wherein the pressure source inlet is connected to annulus pressure around a tubular within a wellbore.

Embodiment 15: The trigger as claimed in claim 1 wherein the pressure source inlet is connected to a dedicated pressure source.

Embodiment 16: The trigger as in any prior embodiment, wherein the first incrementing feature includes a push nut.

Embodiment 17: The trigger as in any prior embodiment, wherein the first incrementing feature and second incrementing feature are disposed in the same direction as each other.

Embodiment 18: The trigger as in any prior embodiment, wherein the second incrementing feature is attached to a connector attached to the housing and dynamically sealed to the rod.

Embodiment 19: The trigger as in any prior embodiment, wherein the trigger increments with an increase pressure phase of a pressure cycle.

Embodiment 20: The trigger as in any prior embodiment, wherein the trigger increments with a decrease pressure phase of a pressure cycle.

Embodiment 21: A borehole system including a borehole disposed in a subsurface formation; a string disposed in the borehole; a trigger as in any prior embodiment in operative contact with the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An actuation trigger comprising:

a housing;

a piston in operable communication with the housing;

a pressure source inlet to the trigger the piston being responsive to source pressure cycles;

and a rod incrementally movable with the piston and movable relative to the housing in only one direction, the rod initially being part of a dynamic seal preventing actuation pressure access to a tool actuatable by the actuation pressure and wherein the actuation pressure is the source pressure.

2. The trigger as claimed in claim 1 further including a first push nut positioned to slide on the rod in one direction and jam in the opposite direction.

3. The trigger as claimed in claim 2 further including a second push nut positioned to slide on the rod in one direction and jam in the opposite direction.

4. The trigger as claimed in claim 3 wherein the first push nut and second push nut are disposed in the same direction as each other such that the rod is movable in only one direction relative to both of the first push nut and the second push nut.

5. The trigger as claimed in claim 3 wherein the second push nut is attached to a connector attached to the housing and dynamically sealed to the rod.

6. The trigger as claimed in claim 3 wherein the second push nut includes a collet.

7. The trigger as claimed in claim 1 wherein the rod is pressure balanced.

8. The trigger as claimed in claim 1 further including a biasing member in operable contact with the piston.

9. The trigger as claimed in claim 1 wherein the pressure source inlet is through a pressure inlet sub.

10. The trigger as claimed in claim 9 wherein the dynamic seal is in the pressure inlet sub.

11. The trigger as claimed in claim 1 wherein the dynamic seal is in a connector attached to the housing.

12. The trigger as claimed in claim 1 wherein the rod is hollow.

13. The trigger as claimed in claim 1 wherein the rod is solid.

14. The trigger as claimed in claim 1 wherein the housing is configured to directly access tubing pressure of a tubular member adjacent the trigger.

15. The trigger as claimed in claim 1 wherein the pressure source inlet is connected to tubing pressure in a tubular within a wellbore.

16. The trigger as claimed in claim 1 wherein the pressure source inlet is connected to annulus pressure around a tubular within a wellbore.

17. The trigger as claimed in claim 1 wherein the pressure source inlet is connected to a dedicated pressure source.

18. The trigger as claimed in claim 1 wherein the first push nut includes a collet.

19. The trigger as claimed in claim 1 wherein the trigger increments with an increase pressure phase of a pressure cycle.

20. The trigger as claimed in claim 1 wherein the trigger increments with a decrease pressure phase of a pressure cycle.

21. A borehole system comprising:

a borehole disposed in a subsurface formation;

a string disposed in the borehole;

a trigger as claimed in claim 1 in operative contact with the string.

* * * * *